United States Patent [19]

Ku et al.

[11] 4,091,913

[45] May 30, 1978

[54] PRINTING APPARATUS WITH PRINTING MATERIAL NON-MOTION DETECTOR

[75] Inventors: Joseph P. Ku, Foster City; Fereidoon Matin, Pleasant Hill; Richard D. Trezise, San Jose, all of Calif.

[73] Assignee: Xerox Corporation, Stamford, Conn.

[21] Appl. No.: 747,768

[22] Filed: Dec. 6, 1976

[51] Int. Cl.[2] ..... B41J 33/14

[52] U.S. Cl. ..... 400/124; 400/225; 226/45

[58] Field of Search ..... 197/151, 168, 173, 174; 226/10, 11, 24, 33, 37, 45

[56] References Cited

U.S. PATENT DOCUMENTS

| | | | |
|---|---|---|---|
| 3,566,132 | 2/1971 | Walker | 226/45 X |
| 3,713,571 | 1/1973 | Simonton | 226/45 |
| 3,917,142 | 11/1975 | Guarderas | 226/45 X |
| 3,939,957 | 2/1976 | Bittner | 197/151 |
| 3,949,856 | 4/1976 | Ulber et al. | 226/45 X |

*Primary Examiner*—E. H. Eickholt

*Attorney, Agent, or Firm*—Barry Paul Smith

[57] ABSTRACT

A printing apparatus includes a supply of printing material, a drive assembly coupled to the printing material and capable when enabled of advancing the material along a predetermined path past a printing station, and a detection device for detecting when the printing material fails to be advanced by at least a first predetermined amount when the drive assembly has been enabled to advance the material by at least a second predetermined amount.

15 Claims, 9 Drawing Figures

PRINTING APPARATUS WITH PRINTING MATERIAL NON-MOTION DETECTOR

BACKGROUND OF THE INVENTION

This invention relates to printing apparatus and, more particularly, to printing apparatus of the type including a supply of printing material and a drive assembly coupled to the printing material and capable when enabled of advancing the material along a predetermined path past a printing station.

Printing apparatus of the above-described type have been known and used for decades, such as in the ordinary conventional typewriter, as well as, and more recently, in computer output printers and so-called "word-processing" systems. An example of a computer output printer is the Diablo HyType II Printer manufactured by Diablo Systems, Inc. of Hayward, Calif., and an example of a word-processing system is the Xerox 800 Electronic Typing System manufactured by the Xerox Corporation of Dallas, Tex.

Contemporary computer output printers and word-processing systems generally utilize a ribbon cartridge which houses a printing ribbon and has a drive mechanism connectable to an external drive source for advancing the ribbon along a predetermined path past a printing station located exteriorily of the cartridge. The cartridge may either be of the reel-to-reel type, such as disclosed in copending U.S. application Ser. No. 633,530 filed on Nov. 19, 1975 in the names of Mario G. Plaza and Richard D. Trezise and assigned to the assignee of the present invention (now U.S. Pat. No. 4,034,935), or the endless-loop type, such as disclosed in copending U.S. application Ser. No. 689,429 filed on May 24, 1976 in the names of Richard D. Trezise and Kip E. Nelson and also assigned to the assignee of the present invention (now abandoned).

It has previously been the practice in the case of reel-to-reel ribbon cartridges as used in a printing apparatus of the type above-described to incorporate some detectable indicia on the ribbon adjacent the end thereof on the supply reel in order to detect when the ribbon supply is about to be depleted. Typically, this indicia may include a strip of either reflective, transmissive or magnetically-sensitized material. Then, a suitable photo-electric or magnetic detection device at an appropriate location adjacent the path of movement of the ribbon could generate a RIBBON-OUT signal when the indicia is detected. Appropriate control circuitry in the printing apparatus would normally respond to such signal in a manner disabling further printing until a new cartridge has been inserted.

Although this approach has worked well in detecting the end of a fixed length of ribbon, it would not prove useful in the case of an endless loop ribbon. Further, in either types of ribbon cartridges, there would be no means of detecting either when the ribbon is not being advanced at all, due to a jam, broken ribbon, or failure of the cartridge drive mechanism, or when the ribbon is not being advanced fast enough, such as when it is slipping relative to its drive mechanism, or when the ribbon is not even present, such as when a ribbon cartridge has not been loaded into the printer.

It would be desirable, therefore, to provide in a printing apparatus of the type above-described an effective means for detecting the non-advancement, slippage or absence of a printing material regardless of whether it is of the endless-loop type or fixed length type, such as in the case of a reel-to-reel assembly.

SUMMARY OF THE INVENTION

In accordance with the present invention, a printing apparatus is provided comprising a supply of printing material, drive means coupled to the material and capable when enabled of advancing the material along a predetermined path past a printing station, and means for detecting when the material fails to be advanced by at least a first predetermined amount when the drive means has been enabled to advance the material by at least a second predetermined amount.

In view of this arrangement, it make no difference whether the printing material is in an endless-loop or has a fixed finite length. Non-advancement of printing material by said first predetermined amount will nonetheless be detected. Further, if the printing material has not been loaded into the printing apparatus, the detection means of the present invention will sense this when it detects a non-advancement by said first predetermined amount. It will also be appreciated that slippage of the printing material relative to its drive means can also be detected if the material does not advance by said first predetermined amount.

In accordance with a preferred embodiment, the printing material is an endless loop of ribbon housed in a ribbon cartridge. The cartridge includes a drive assembly connected to an external drive source for advancing the ribbon through a predetermined path in the cartridge and exteriorily of the cartridge past an adjacent printing station. The cartridge includes an idler roller which is rotated upon advancement of the ribbon by the drive assembly. A plurality of equally spaced reflective strips are mounted to a surface of the idler roller and extend radially from the axis thereof. As the idler roller rotates, the strips pass sequentially past an opening in the cartridge.

A photo-emitter and detection device is located adjacent the cartridge opening to detect any light reflected from the area of the opening. Such reflection occurs each time a reflective strip passes through the opening. Circuitry is associated with the photo-detection device for generating a reset pulse each time a reflective strip is detected. Each reset pulse is coupled to a counter for resetting same.

In the preferred embodiment, the counter counts position pulses generated by a position transducer apparatus coupled to the drive motor ultimately used to advance the ribbon through the cartridge. Each position pulse represents an intended advancement of the ribbon a predetermined incremental distance through the cartridge. The counter is arranged so that it will generate a COUNTER-FULL signal when a predetermined number, X, of position pulses have been counted. Each reset pulse normally occurs every time a predetermined number, Y, of position pulses have been counted, where Y is preferably less than X. Accordingly, the counter normally will be reset prior to a full count X being reached.

If, then, the ribbon fails to be advanced by at least a distance sufficient to generate a reset pulse prior to the counter reaching a full count of X pulses, the counter will provide a COUNTER-FULL signal. In the preferred embodiment, the COUNTER-FULL signal is applied to a latch circuit where a DISABLE signal is generated for disabling the system control in order to discontinue the printing operation.

It will be appreciated that the counter will cause a DISABLE signal to be generated whenever it is intended to drive the ribbon by an amount represented by at least X position pulses (i.e. at least a second predetermined amount), but that the ribbon fails to be advanced by an amount represented by at least Y position pulses (i.e. at least a first predetermined amount). Such failure of advancement may be due to a failure of the cartridge drive assembly or slippage of the ribbon relative to such drive assembly, or even failure to load a cartridge into the printer.

These and other aspects and advantages of the present invention will be more completely described below with reference to the accompanying drawings.

DESCRIPTION OF THE PREFERRED EMBODIMENT

Figure 1:
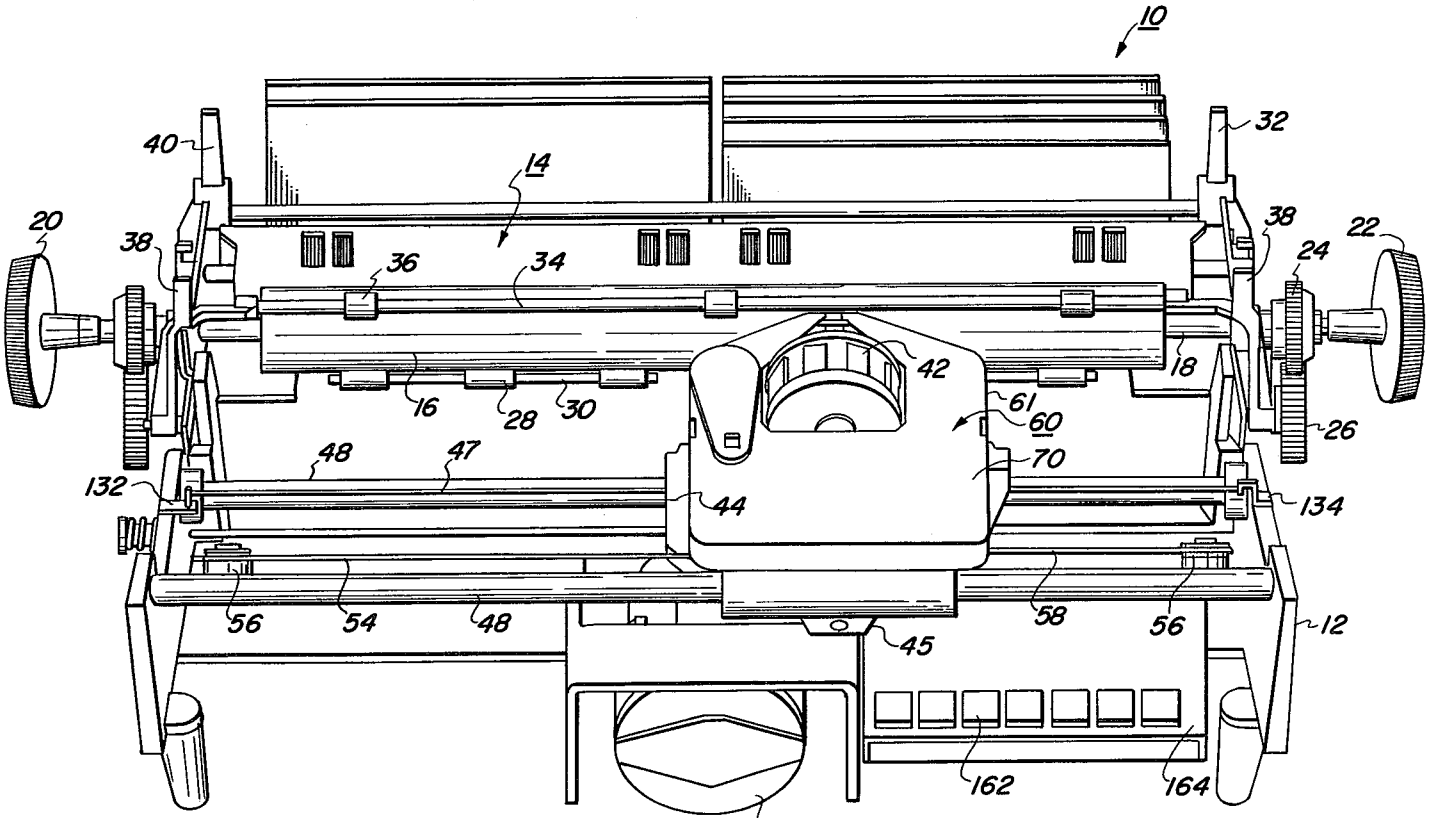
FIG. 1 is a perspective view of a printer including the printing apparatus of the present invention therein.

Referring to FIG. 1, the printing apparatus of the present invention is shown, by way of example, as being included in and forming part of a matrix-type serial printer 10. However, it will become readily apparent that such printing apparatus could equally well be employed in any serial printer, such as type-bar printers and so-called "daisy-wheel" printers. An example of the latter type of serial printer is the above-mentioned Diablo HyType II Printer.

As shown in FIG. 1, the printer 10 includes a unitary frame 12 to which a platen assembly 14 is mounted for rotation about its axis. More specifically, the platen assembly 14 includes a platen 16 mounted to a shaft 18 for rotation therewith. The shaft 18 is, in turn, rotatably mounted to the frame 12 and includes a pair of knobs 20 and 22 mounted at respective ends of the shaft for enabling manual controlled rotation of the shaft 18 and platen 16. As is conventional, the knob 20 is fixed to the shaft and the knob 20 is movable axially of the shaft between first and second positions. When in a first position, a gear-drive assembly 24 mounted about the shaft 18 adjacent the knob 22 is engaged with the shaft so that a motor-gear arrangement 26 (only partly shown) coupled to the gear-driven assembly 24 controls the automatic rotation of the shaft 18. When in a second position, the knob 22 disengages the gear-drive assembly 24 from the shaft so that manual rotation of the knobs 20 and 22 will cause a corresponding rotation of the shaft 18 and platen 16.

The platen assembly 14 also comprises a plurality of pressure rollers 28 connected to one or more lower bail bars 30. By way of example, four bail bars 30 are employed (only the front two visible), each bail bar having three rollers 28 rotatably mounted thereon. As is conventional in serial printers and typewriters, a spring-biased lever 32 is included in the printer 10 for manual movement between a first or rearward position and a second or forward position. Conventional linkage means (not shown) is provided for maintaining the rollers 28 in pressure engagement with the platen when the lever 32 is at its first position and for retracting and holding the rollers 28 a predetermined distance from the platen 16 when the lever is moved to its second position. With the rollers 28 in pressure engagement with the platen 16, a record material (not shown) may be positively fed through the printer 10 along the platen and past a printing station (to be defined below) as the platen is rotated either manually or automatically.

The platen assembly 14 further includes an upper bail bar 34 having a plurality, e.g. three, follower rollers 36 rotatably mounted thereon. These rollers, when engaged with the platen 16, serve to hold the record material on the platen so that it is directed from the printer 10 in a generally rearward direction, as is conventional. Conventional spring-biased levers 38 are connected to the printer 10 and to the bail bar 34 for maintaining the rollers 36 in pressure engagement with the platen 16 when the levers 38 are in a first or rearward position, and for removing and holding the bail bar 34 and thus rollers 36 a predetermined distance forwardly of the platen 16 when the levers 38 are moved to second or forward position.

In order to accomodate record material or different thicknesses, the platen assembly 14 also preferably includes a lever 40 connected to the printer 10 and capable of being manually positioned at a number of detent positions corresponding to desired distances of the platen 16 from a matrix print head 42 mounted adjacent the platen and to be described in more detail below. Appropriate and conventional linkage and mounted means (not shown) coupled between the lever 40 and the platen 16 achieves the desired shifting of the platen in response to movement of the lever 40. The platen assembly 14 as thus described is entirely conventional and further details thereof may be obtained, by way of example, through a review of the aforementioned Diablo HyType II Printer.

Figure 4:
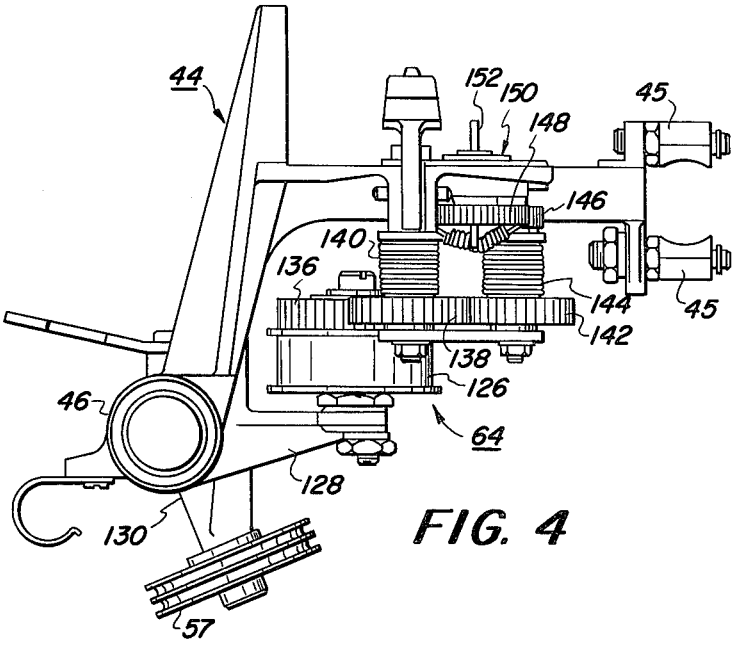
FIG. 4 is a side elevation view of the carriage assembly of the printer of FIG. 1.

Referring to FIGS. 1 and 4, the printer 10 also includes a carriage assembly 44 mounted by a pair of bearing members 45 and 46 to a respective pair of rods 48 which are themselves mounted at each end to the frame 12 of the printer 10. A drive motor 52 is coupled by a suitable cable-pulley arrangement 54 to the carriage assembly 44. As is conventional, the cable-pulley arrangement includes a first pulley (not shown) connected to the shaft of the drive motor 52, a plurality (e.g., 2 or 4) second pulleys 56 coupled to opposing sides of the frame 12 and a third pulley 57 connected to the carriage assembly 44. At least one cable 58 (deleted from FIG. 4) is wrapped around the pulleys for imparting linear motion to the carriage assembly 44 along the rails 48 in response to rotation of the motor-drive shaft. For more details of the specific cable-pulley arrangement shown in the drawings, reference may be had to the aforementioned Diablo HyType II Printer.

The carriage assembly 44 generally includes and is adapted to transport the matrix print head 42, (deleted from FIG. 4), which may be of any suitable type, but preferably is of the type disclosed in copending application No. 700,417 filed on June 28, 1976 in the name of Donald G. Hebert and assigned to the assignee of the present invention (now U.S. patent No. 4,051,941. The print head 42 is fixed to the carriage assembly along with a ribbon cartridge 60 (also deleted from FIG. 4)

for advancing inked ribbon 62 (FIG. 2) between the matrix print head 42 and the platen 16, and the external portion of a ribbon cartridge drive assembly 64 for transporting the ribbon 62 in front of the matrix print head 42 during operation of the printer 10. The specific nature of a preferred ribbon cartridge drive assembly 64 will be described in more detail below. At this point, however, it should be noted that the ribbon 62 is advanced only in a single direction past the head 42 synchronously with the movement of the carriage assembly 44 in either direction.

Figure 5:
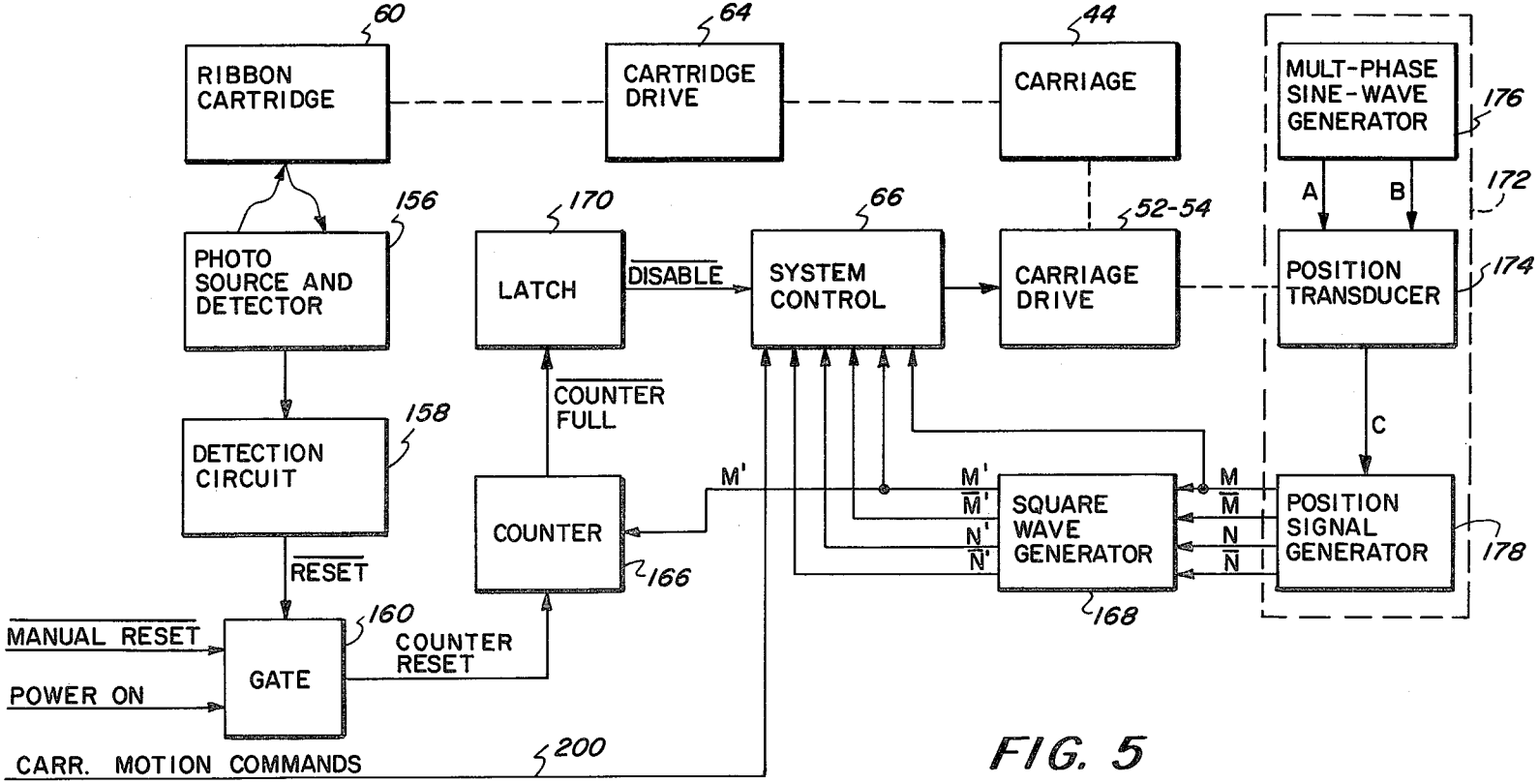
FIG. 5 is a functional block diagram representation of portions of the printer of FIG. 1 including the printing apparatus of the present invention.

As is conventional in matrix printers, the print head 42 comprises a plurality of wires (not shown) arranged in a vertical array at the end of the head adjacent the platen. Each character to be printed is formed by a predetermined number of closely adjacent dot columns. The dots of each column are formed by selective activation of appropriate wires in the head 42 to prospel them and the adjacent ribbon 62 against the platen 16. Activation of the wires at the appropriate times and in response to input character commands may be accomplished by suitable hardware and/or software included in a central system control 66 (FIG. 5). As is the case with most matrix printers, characters are printed "on-the-fly", i.e. as the carriage assembly 44 is being moved in one direction or the other. The specific manner in which the characters are printed forms no part of the present invention and thus shall not be described in detail. Such details, however, if desired, may be obtained through a review of copending application No. 700,418 filed on June 26, 1976 in the names of Robert A. Ragen and Carl E. Herendeen (now U.S. Pat. No. 4,029,190.

Figure 2:
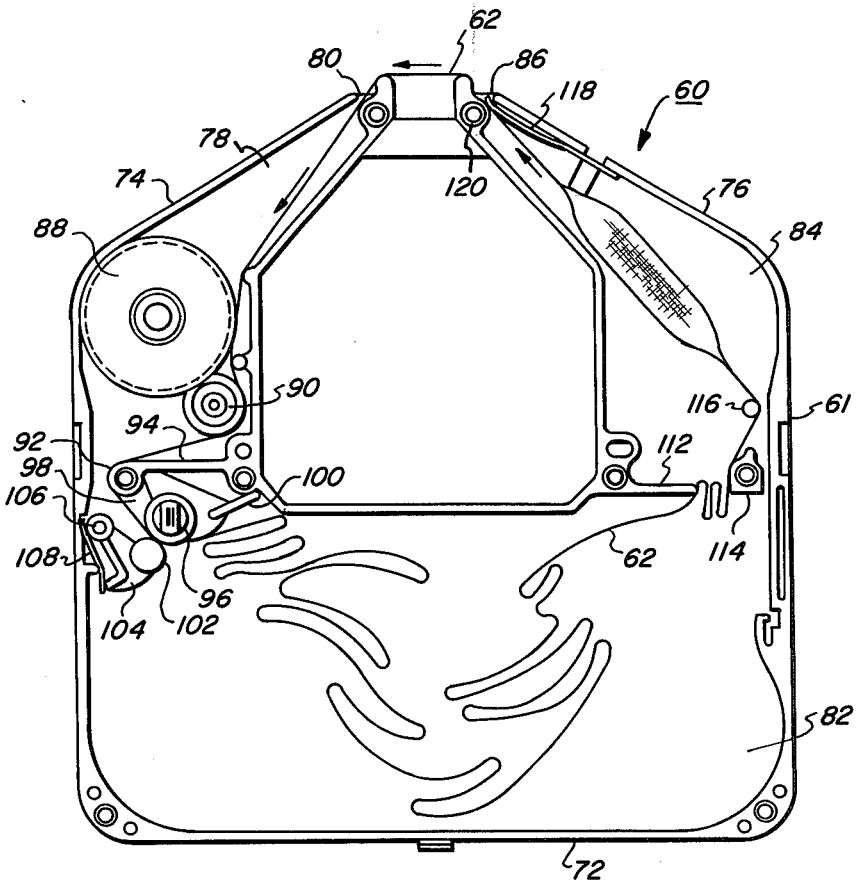
FIG. 2 is a top plan view with the top cover removed of the ribbon cartridge depicted in FIG. 1.
Figure 3:
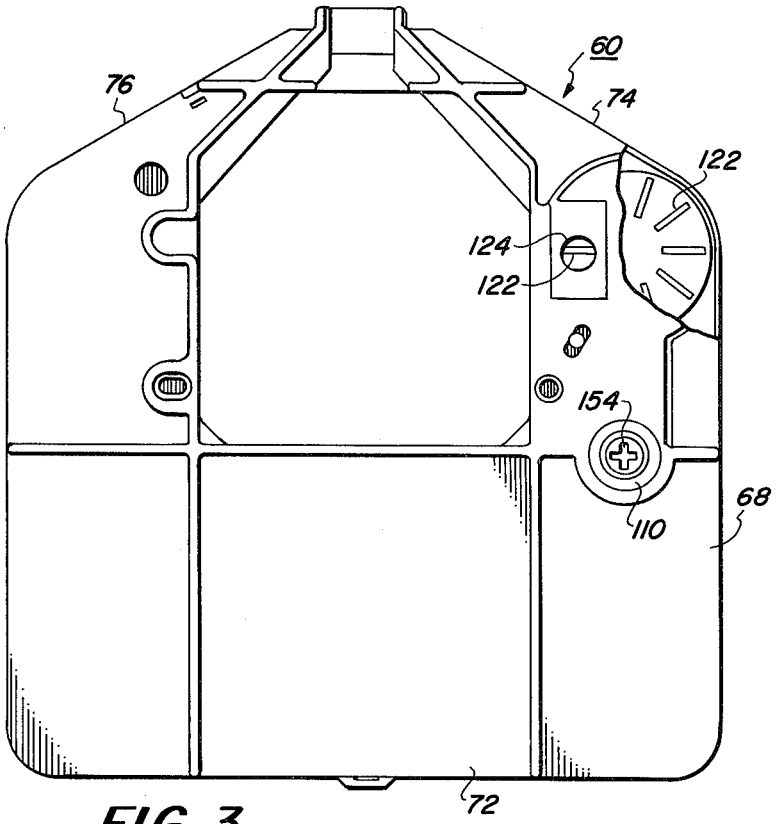
FIG. 3 is a bottom plan view, partly broken away, of the ribbon cartridge of FIG. 2.

Referring now to FIGS. 1–3, the ribbon cartridge 60 is shown comprising a housing 61 formed by a bottom portion 68 and a top portion 70 which are fitted together by suitable pin-receptable combinations. The cartridge housing 61 is preferably generally U-shaped having a main portion 72 and two depending flange portions 74 and 76. The flange portions 74 and 76 are preferably tapered and are desirably inclined toward one another in a direction away from the main portion 72.

As best shown in FIG. 2, an input feeding chamber 78 is defined in the housing 61 in the flange portion 74 between the opposing inner surfaces of the bottom and top portions 68 and 70 of the housing. These opposing inner surfaces shall hereafter be referred to as the floor and ceiling, respectively, of the housing. The flange portion 74 has an input opening or port 80 at its outermost end communicating with the feeding chamber 78 and adapted to receive an endless loop of ribbon 62 of predetermined thickness. The ribbon is advanced through the port 80 into the feeding chamber 78 by the drive assembly 64 to be described in more detail below. From the feeding chamber 78, the ribbon 62 is fed through a first gating means, also to be described below, into a main storage chamber 82 where it is stored in a randomly positioned manner, as shown diagramatically in FIG. 2. The main storage chamber 82 is defined generally in the main portion 72 of the housing 61 between the floor and ceiling of the housing.

From the main storage chamber 82, the ribbon 62 is fed through a second gating means, to be described below, into an output feeding chamber 84 defined in the flange portion 76 of the housing 61 between the floor and ceiling thereof. Flange portion 76, like flange portion 74, has an output opening or port 86 defined at the outermost end thereof and communicating with the output feeding chamber 84. From the output feeding chamber 84, the ribbon 62 is fed out of the cartridge 60 through the output port 86 and then across the gap between flange portions 74 and 76 and back into the cartridge through the input port 80.

Referring now in more detail to FIG. 2, an inking idler roller 88 is rotatably mounted by suitable means in the input feeding chamber 78. The roller 88 may be any conventional roller capable of storing and transfering a supply of ink to an object in contact herewith. For example, the roller 88 may be formed of a porous material capable of being periodically saturated with an inking fluid. Also rotatably mounted in the input feeding chamber 78 is a transfer roller 90. The transfer roller 90 may be of any suitable type capable of accepting a measured amount of inking fluid from the roller 88 when such rollers are rotated relative to and in contact with one another.

Ribbon fed into the input feeding chamber 78 is guided by the side walls of the housing 61 into contact with the transfer roller 90 where the ribbon 62 accepts a measured supply of ink from the roller 90 and is thus "re-inked." From the transfer roller 90, the ribbon 62 is fed around a rounded bearing member 92 defined on the end of a flange portion 94 projecting across the chamber 78 from the inner side wall of the bottom portion 69. From the bearing member 92, the ribbon 62 is advanced to the drive assembly 64 and first gate means alluded to above.

The ribbon cartridge drive assembly 64 preferably comprises a first portion located within the cartridge housing 61 and a second portion located exteriorily thereof and coupled to the carriage, as alluded to above. The first internal portion preferably includes a conventional capstan roller 96 rotatably supported on a first pivot member 98 pivotably mounted by suitable means to the flange portion 94 at the bearing member 92. A deflector member 100 is defined on the pivot member 92 for contacting the adjacent side wall of the bottom portion 68 for a purpose to be described below. The drive assembly 64 also comprises a follower roller 102 supported on a second pivot member 104 pivotably mounted by suitable means about a pivot post 106 upstanding from the floor of the cartridge housing 61. A leaf spring 108 is mounted between the pivot member 104 and the adjacent side wall for biasing the follower roller 92 against the capstan drive roller 96. The capstan drive roller communicates with an opening 110 (FIG. 3) through the bottom portion 68 of housing in order for the second external portion of the drive assembly 64, to be described below, to engage and drive the capstan roller 96.

From the nip between rollers 96 and 102, the ribbon 62 is advanced into the main storage chamber 82 where it is randomly positioned as shown. This nip represents the first gating means alluded to above. The second gating means referred to above is defined primarily by a pair of bearing members 112 and 114. The bearing member 112 is, in turn, defined by an extension wall extending partly across the housing 61 at the boundary of the main storage chamber 82 and the output feeding chamber 84. The bearing member 114 is defined by a post upstanding from the floor of the housing 61.

The ribbon 62 is fed through the second gating means along the bearing member 114 into the output feeding chamber 84 where it is directed along a guide pin 116 and then twisted 180° before exiting the cartridge housing through the output port 86. A leaf spring 118 may be provided at the output end of the chamber 84 in biasing engagement with a bearing member 120 in order to insure that only a single strip of ribbon will exit from the cartridge.

Referring to FIG. 3, and in accordance with the present invention, the underside of the inking roller 88 has formed thereon a plurality of radially arranged strips 112 which are spaced a predetermined distance from one another. The strips are preferably made of a light-reflective material, although as will become clear below, a magnetically-sensitized material could equally well be employed. The bottom portion 68 of the cartridge housing has an opening 124 formed along the path of movement of the strips 122 as the roller 88 is rotated due to movement of the ribbon 62 through the cartridge 60. Accordingly, as the roller 88 is rotated, the strips 122 will sequentially pass through the area of the opening 124. The purpose of this arrangement will be described in detail below.

Referring now to FIG. 4, a presently preferred second external portion of the ribbon cartridge drive assembly 64 will be described. As alluded to earlier, FIG. 4 depicts the carriage assembly 44 per se as a unit. No other components of the printer 10 are shown in order to highlight the specific component parts of the carriage assembly.

The second external portion of the drive assembly 64 includes a drive drum 126 rotatably mounted by suitable means to a flange portion 128 of the carriage frame 130. A cable 47 (shown in FIG. 1 only) is wrapped around the drum with one end connected to a first fastener 132 (FIG. 1) mounted to the left side wall of the frame 12 of the printer 10, and the other end of the cable 47 is connected to a second fastener 134 (FIG. 1) mounted to the right side wall of the frame 12. It will thus be appreciated that the drum 126 will rotate in either direction in response to linear movement of the carriage assembly by the carriage drive assembly 52–54.

Formed on the upper periphery of the drum 126 is a gear 136 having spaced teeth (not shown). The gear 136 is engaged with another gear 138 formed on the lower periphery of a first conventional one-way clutch device 140. The gear 138 is, in turn, engaged with yet another gear 142 formed about the lower periphery of a second conventional one-way clutch device 144. Each of the clutch devices 140 and 144 has another gear 146 formed about the upper periphery thereof (only the gear 146 of clutch device 146 is visible). Both gears 146 are, in turn, engaged with a gear 148 formed at the lower end of a capstan drive mechanism 150 which includes a drive key 152 rotatable in response to rotation of the gear 148 by the gears 146. The key is adapted to engage a keyway 154 (FIG. 3) formed at the lower exposed end of the capstan drive roller 96 in order to rotate same.

In operation, movement of the carriage assembly 44 in either direction will cause the drum 126 to rotate in the corresponding direction. Through gears 136, 138 and 142, the clutch devices 140 and 142 will be operative to rotate the capstan drive mechanism 152 only counter-clockwise. More specifically, when the carriage assembly 44 is driven toward the left (FIG. 1), the clutch device 140 will slip and the clutch device 142 will engage to drive the mechanism counter-clockwise. When the carriage assembly 44 is moved toward the right, the clutch device 142 will slip and the clutch device 140 will engage and drive the mechanism 152 still in a counter-clockwise direction. Accordingly, the ribbon 62 (FIG. 2) will be always be advanced in a single direction regardless of the direction of movement of the carriage assembly 44.

As will be appreciated below, the use of the specific second external portion of the carriage drive assembly 64 described above is merely exemplary, although presently preferred. Other suitable drive arrangements could be employed, such as a stepper motor drive or the like. It is not essential for the ribbon cartridge drive 64 to be dependent upon the movement of the carriage assembly 44.

Referring now to FIG. 5, the unique printing apparatus of the present invention will be described in more detail. As shown, the printing apparatus includes a photo-light source and detector drive 156 which may be of any suitable conventional type and which is desirably mounted by suitable means (not shown) to the carriage assembly 44 at a location in light communication with the opening 124 (FIG. 3) formed in the bottom portion 68 of the cartridge housing. A presently preferred photo-light source and detector device 156 will be described in more detail below with reference to FIG. 6. At this point, however, it should be noted that the device directs a beam of light toward the opening 124 where it will be reflected back to the detector portion of the device each time a reflective strip 122 (FIG. 3) intersects the light beam. The detector portion of the device 156 will then generate a signal each time it senses the reflective light from a reflective strip.

It should be noted at this point that, although the printing apparatus of the invention preferably includes reflective strips and photo-detection, it could alternatively employ magnetically-sensitized strips and magnetic-detection.

Referring again to FIG. 5, the signal from the device 156 is applied to detection circuit 158 which generates a $\overline{\text{RESET}}$ signal in the form of a low level pulse of predetermined duration that is applied to one input of a gating circuit 160. The $\overline{\text{RESET}}$ signal is true at a high level so that a false $\overline{\text{RESET}}$ signal (low level) is the same as a true RESET signal, i.e. the state at which a reset will occur. In the further, reference to a $\overline{\text{RESET}}$ signal being present or having occurred shall be deemed to refer to its false or low level state. The same relationship shall apply with respect to all other signals indicated by their complements in FIGS. 5 and 6. Correspondingly, all signals indicated in their non-complement format, e.g. POWER ON, shall be deemed to be present or have occured when at true or high level state. A presently preferred detection circuit 158 and gating circuit 160 will be described in more detail below in connection with FIG. 6. At this point, however, it should be noted that the gating circuit 160 also receives two other inputs, i.e. a POWER ON signal and a $\overline{\text{MANUAL RESET}}$ signal. The POWER ON signal is a signal of predetermined duration generated after the printer 10 is turned on. The $\overline{\text{MANUAL RESET}}$ signal is generated by the operator through an external switch 162 (FIG. 1) included on a control console 164 (FIG. 1). The control console includes other switches, such as on-off, interrupt, etc. These other switches and their functions form no part of the present invention and thus will not be described in detail.

The gating circuit 160 desirably performs an OR function so that which ever of the three inputs are present, a COUNTER RESET signal will be developed at the output thereof. This COUNTER RESET signal is applied to a conventional increment counter 166 for resetting same. Accordingly, it will be appreciated that each time the device 156 senses the passing of a reflective strip 122 through the opening 124, the counter 166 will be reset to zero.

The counter 166 has an input for receiving a train of pulses M' generated at the output of a square-wave generator 168 to be described in more detail below. The frequency of the pulses M' are directly proportional to the speed of movement of the carriage assembly 44, and thus is proportional to the intended speed of advancement of the ribbon 62 through the ribbon cartridge 60. In accordance with the present invention, the spacing of the reflective strips 122 and the gear ratios of the gears 136, 138, 142, 146 and 148 is selected such that, if the ribbon and thus roller 88 is being properly advanced, a $\overline{\text{RESET}}$ signal will be generated at the output of the detection circuit 158 which, when gated through the gating circuit 160, will cause the counter to be reset prior to the counter reaching a full count. The specific manner in which the pulse train M' is generated will be described in more detail below.

In the event that, for some reason, a reflective strip 122 is not detected by the device 156 during a time when the ribbon 62 is to be advanced a distance sufficient to enable the counter 166 to count up to a full state, a $\overline{\text{COUNTER FULL}}$ signal will be generated at the output of the counter. This event may come about where either the ribbon 62 is jammed or broken in the cartridge 60, the ribbon is slipping and advancing ony slightly, the cartridge 60 has not been loaded into the printer, or the cartridge drive assembly 64 has failed. The specific relationship between the capacity of the counter 166, the frequency of the pulses M' and the frequency of the $\overline{\text{RESET}}$ signal from the detection circuit 158 will be described below.

Still referring to FIG. 5, a $\overline{\text{COUNTER FULL}}$ signal generated at the output of the counter is applied to a suitable latch circuit 170 which will generate a $\overline{\text{DISABLE}}$ signal in response to receipt of a $\overline{\text{COUNTER FULL}}$ signal. The $\overline{\text{DISABLE}}$ signal is applied to one input of the printer system control 66 for disabling same in order to disable further printing operation. As alluded to earlier, the system control 170 preferably includes a suitable processing control system and a suitable carriage servo control system. A preferred processing control system is a microprocessor suitably programmed and a preferred carriage servo control system is a so-called "dual-mode" servo control system. Exemplary microprocessor control and carriage servo control systems are disclosed in copending application Ser. No. 682,877 filed on May 3, 1976 in the name of Frank D. Ruble, Louis H. Chang and John C. Fravel, and assigned to the assignee of the present invention. As the microprocessor depicted therein is used to control a "daisy-wheel" printer, it would, of course, have to be appropriately reprogrammed for matrix printer operation. Another suitably programmed microprocessor that could be employed in the system control 66 is the Intel 8080 microprocessor, manufactured by the Intel Corporation of Santa Clara, Calif. As the specific nature of the system control 66 of printer 10 forms no part of the present invention, other than to be disabled upon receipt of a $\overline{\text{DISABLE}}$ signal, it will not be described in detail herein.

Referring still to FIG. 5, the specific manner by which the pulses M' are generated will be described. A position transducer apparatus 172 is provided for generating a plurality of position signals M, M, N and N, where M and N are desirably phase-displaced by a predetermined amount, e.g. 90°. The position transducer apparatus 172 is desirably of the phase-sensitive type and a presently preferred phase-sensitive transducer apparatus is disclosed in the copending application Ser. No. 670,463 filed on Mar. 25, 1976 in the name of Kenneth W. Cocksedge and assigned to the assignee of the present invention. In accordance with that transducer apparatus, a position transducer 174 is provided of the type comprising a stator (not shown) with two windings displaced in space-phase by a predetermined amount, e.g. 90°, and a rotor (not shown) having a single winding. The rotor is coupled to the shaft (not shown) of the carriage drive motor 52, whereas the stator is fixed to the frame of the printer 10. The rotor is thus rotatable relative to the stator as the motor 52 is driven. An example of a linear-type phase-sensitive transducer that could alternatively be employed is disclosed in copending U.S. application Ser. No. 747,116 filed on Dec. 2, 1976 in the names of Louis G. Gitzendanner and Frank V. Thiemann and assigned to the assignee of the present invention. In the latter transducer, the two winding scale would be fixed to the printer with the slider attached to the carriage for movement relative thereto.

In accordance with phase-sensitive transducers, a pair of phase-displaced sinusoidal signals A and B of identical peak amplitude and frequency are respectively applied to the two windings of the rotor from a suitable multi-phase sinewave generator 176. An example of one such generator is disclosed in the above-mentioned application Ser. No. 670,463. As the rotor is rotated relative to the stator, i.e. as the carriage assembly 44 is driven in one direction or the other by the drive assembly 52–54, a signal C is induced on the winding of the rotor that is of constant peak amplitude and frequency, but variable in phase. The change in phase-angle is proportional to the linear movement of the carriage assembly 44.

A position signal generator 178 receives the variable-phase output signal C and includes circuitry for generating the four position signals M, M, N and N, which are desirably triangular-wave signals with signals M and N being 90° out-of-phase, and wherein each zero-crossing of the position signal M, for example, can be used to define advancement of the carriage assembly one predetermined increment of movement, such as one-half a dot column space. Such position signal generators are entirely well-known. A presently preferred position signal generator is disclosed in the above-mentioned application Ser. No. 670,463.

As is conventional in serial printers utilizing position signals of the type generated by generator 178, i.e. triangular-wave signals M, M, N and N, these signals are generally squared by a suitable and conventional square-wave generator 168 in order to generate four square-wave signals M', M', N' and N'. As is also conventional in serial printers utilizing dual-mode carriage servo control systems, such as the Diablo HyType II Printer, at least some of the four square-wave signals are applied to the system control 66 along with CARRIAGE MOTION COMMAND signals (applied on a bus 200 — FIG. 5) in order to generate ACTUAL CARRIAGE VELOCITY and COMMAND CARRIAGE VELOCITY signals. The latter two signals which are compared during a first mode of operation with the resultant VELOCITY ERROR signal being used to drive the carriage drive motor 52. In a second mode of operation, one of the triangular position signals, e.g. signal M, would be applied to the system control 66 for comparison with the ACTUAL CARRIAGE VELOCITY signal, as is conventional. These well-known principles of dual-servo operation are described in the aforementioned application Ser. No. 682,877, as well as in U.S. Pat. No. 3,954,163.

In the matrix printer 10, therefore, the four square-wave position signals M', M', N' and N' are applied to the system control 66 along with the triangular-wave position signal M. The output from the system control 66 is the servo system drive signal that is applied to the carriage drive motor 52 for operating the carriage drive-assembly 52–54 to move the carriage assembly 44 is the desired direction.

In accordance with the presently preferred embodiment of the invention, the pulses defined by the square-wave position signal M' are applied to the input of the counter 166 for incrementing same. Each pulse of the position signal M' occurs at every other null point of the position signal M and is thus representative of the advancement of the carriage assembly 44 a distance equal to one full character dot column space. Further, and in accordance with the preferred embodiment, there are 5 character dot columns per character space increment and the counter is arranged to store up to a count of 256, i.e. 51 characters. Further, each RESET pulse from detection circuit 158 is normally arranged to occur every 12 characters, i.e. 60 counts. This allows a sufficient lead-time, i.e. time for three more reflective strips 122 to pass through the opening 124 and be detected, until the printer is disabled. Such lead time is desirable in the event one or more of the reflective strips 122 has become sufficiently worn to lose its reflectivity. The selection of 12 character spaces per RESET pulse and 51 character spaces per counter capacity is, of course, merely exemplary and is occassioned by the appropriate selection of gear ratios of the gears 136, 138, 142, 146 and 148, as well as the frequency of the sinusoidal signals A and B, the spacing of the reflective strips 122, etc.

Figure 6:
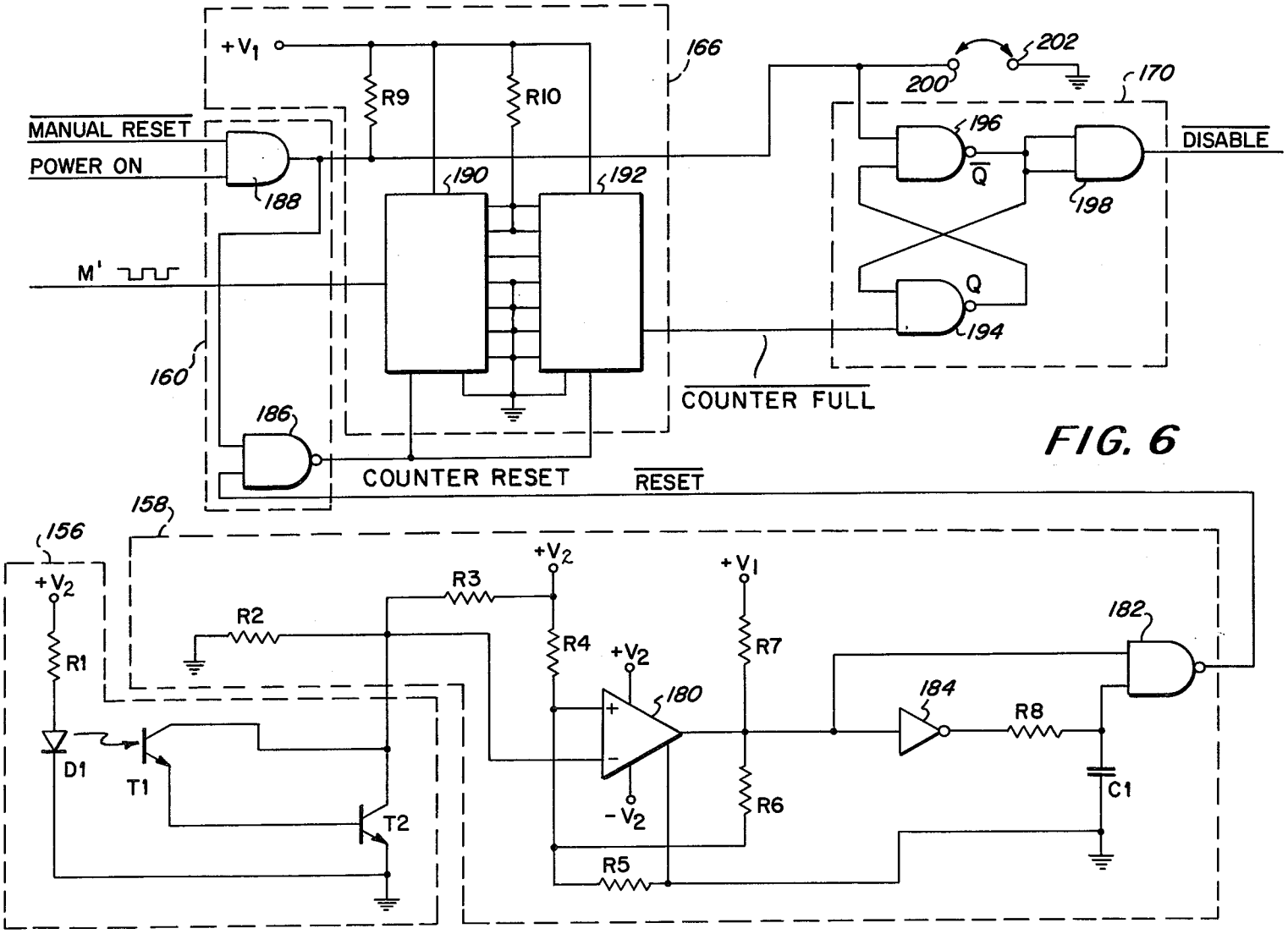
FIG. 6 is a schematic circuit diagram of various of the functional blocks depicted in FIG. 5.

Reference is now had to FIG. 6 where presently preferred circuits for components 156, 158, 160, 166 and 170 depicted in block form in FIG. 5 will be described. Referring first to the photo-source and detector device 156, it preferably is comprised of a light-emitting-diode (LED) D1 having its anode connected through a resistor R1 to a source of supply voltage, +V2, and its cathode connected to ground. The diode D1 directs a beam of light to the area of the opening 124. Light reflected off a reflective strip in the opening 124 is directed to a photo-electric circuit preferably comprised of a photo-sensitive transistor T1 connected in darlington configuration to a second transistor T2, i.e. the emitter electrode of transistor T1 is connected to the base electrode of transistor T2 and the collector electrode of transistor T1 is connected to the collector electrode of transistor T2. The emitter electrode of transistor T2 is grounded. The components R1, D1, T1 and T2 comprise the device 156.

The collector electrodes of transistors T1 and T2 are connected to the inverting input terminal of a comparator amplifier 180 and through a resistor R2 to ground. The voltage source +V2 is also connected through a resistor R3 to the inverting input of the comparator 180. The resistors R2 and R3 together define a voltage divider. The non-inverting input of the comparator 180 is connected through a resistor R4 to the voltage source +V2 and through a resistor R5 to ground. The two voltage terminals of the comparator are respectively connected to voltage supply sources +V2 and −V2.

The output of the comparator 180 is fedback through a resistor R6 to the positive input terminal thereof and is coupled to the source voltage +V1 through a resistor R7. The comparator output is also coupled to one input of a NAND-gate 182 and through an inverter 184 and resistor R8 to a second input of the gate. This second input is also connected to ground through a capacitor C1. The output of the NAND-gate 182 represents the $\overline{\text{RESET}}$ signal from the detection circuit 158 (FIG. 5). In this respect, the detection circuit is comprised of components R2–R8, C1, 180, 182, 184, where the components 184, R8, C1 and 182 may be said to comprise a psuedo one-shot, as will become clear below.

In operation, when no light has yet been reflected onto photo-transistor T1, the voltage at the inverting input of the comparator 180 will be greater than that at the noninverting input, due to appropriate selection of the values of resistors R2, R3 and R4, so that the output of the comparator 180 will be at a high level. In this event, the first input to the NAND-gate 182 will be high and the second input, being applied through the inverter 184, will be low. Thus, the output of the NAND-gate 182 will be high (a true $\overline{\text{RESET}}$ or false RESET). When light is reflected toward and sensed by the transistor T1, the inverting input of the comparator 180 is driven to a voltage level less than that of at its non-inverting input. At the instant where the voltage level at the inverting input becomes equal to that at the non-inverting input, the comparator output changes state from high to low. At this point, the first input to the NAND-gate 182 will go low and the second input will go high when the capacitor has charged. Nonetheless, the output will stay high.

Now then, when the reflective strip currently reflecting light has passed through the opening 124 so that it no longer reflects, the inverting input terminal of the comparator 180 will again be driven high. When it reaches a potential equal to that at the non-inverting terminal, the comparator output will again change state from low to high. At this instant, the two inputs to the NAND-gate 182 will be high since the capacitor would not yet have had sufficient time to discharge. Consequently, the output of the NAND-gate will be low, i.e. a false $\overline{\text{RESET}}$ signal will be present. The $\overline{\text{RESET}}$ signal will stay low until the capacitor C1 has discharged and the second input to the NAND-gate 182 is again at a low state. It will be appreciated that the $\overline{\text{RESET}}$ signal is a negative-going pulse having a pulse-width determined by the time-constant of the capacitor C1 and the value of the resistor R8.

Still referring to FIG. 6, the $\overline{\text{RESET}}$ signal from the detection circuit 158 is applied to one input of a NAND-gate 186 included in the gating circuit 160. A second input of the NAND-gate 186 is connected to the output of an AND-gate 188 also included in the circuit 160. A first input of the AND-gate 188 is adapted to receive a POWER ON signal which is true at a high level and is low initially for a finite period after initial power-on of the printer 10. A second input of the AND-gate 188 is connected to the manual reset switch 162 (FIG. 1) for generating a $\overline{\text{MANUAL RESET}}$ signal, also true at a high level. When either inputs to the AND-gate 188 is low, the output will be low. Consequently, if either or both inputs go low, the output will go low. Therefore, if any of the three possible reset signals are initiated, i.e.

MANUAL RESET goes low, POWER ON goes low or RESET goes low, the output of the NAND-gate 186 will be high applying a true COUNTER RESET signal to the counter 166 for resetting same.

The counter 166 is preferably comprised by a pair of conventional 16-bit counters 190 and 192 connected to one another such that the aggregate counter is capable of counting up to 256 (I.e. 16 × 16) where the input pulse signal M' is applied to one input of the counter 190 and the COUNTER FULL signal is developed at an output terminal of the counter 192. The counters 190 and 192 and their inputs are suitably connected to the source voltage +V1 and through a resistor R10. Such source voltage is also connected through a resistor R9 to the output of the AND-gate 188.

The output from the counter 192, i.e. COUNTER FULL signal, is applied to the latch circuit 170 and, more particularly, to one input of a NAND-gate 194 included therein. A second input of that gate is connected to the output of another NAND-gate 196 and to a joined pair of inputs of an AND-gate 198. Gates 196 and 198 are also included in the latch circuit 170. A first input of the NAND-gate 196 is connected to the output of the AND-gate 188 and to one terminal 200 of a jumper, the other terminal 202 of which is grounded. The second input of the NAND-gate 196 is connected to the output of the NAND-gate 194.

In operation, if either input to the AND-gate 188 goes false, i.e. low, the output will go low thereby resetting the latch 170 in order to insure that the DISABLE signal at the output thereof will be true. Thereafter, if the counter 166 is not reset by a COUNTER RESET signal from the NAND-gate 186 prior to the time it counts up to 256, the COUNTER FULL signal will go low thereby setting the latch 170 to bring the DISABLE signal false(low) in order to disable the system control 66 and further printing operation. The jumper 200–202 can be utilized to effectively disconnect the circuits depicted in FIG. 6. Such may be done, for example, when ribbon cartridges not equipped with the reflective strips 122 are employed in the printer 10.

Although the present invention has been described with respect to a presently preferred embodiment, it will be appreciated to those skilled in the art that various modifications, substitutions, etc. may be made without departing from the spirit and scope of the invention as defined in and by the following claims. For example, the non-motion detection apparatus disclosed herein could be used to detect the non-motion of any type of printing material, an inked ribbon being only one type. Paper could be another type of printing material in accordance with the broader aspects of this invention. Accordingly, the use of the term "printing material" herein shall not be deemed in its broader aspects to be restricted solely to an inked ribbon.

What is claimed is:

1. A printing apparatus comprising:

a supply of printing material;

a carriage assembly to which said supply of printing material is mounted;

a carriage drive assembly coupled to said carriage assembly for reciprocally moving same along a predetermined path past a printing station;

drive means mounted to said carriage assembly and operatively coupled to said supply of printing material for advancing said printing material in one direction only in response to and in synchronization with the movement of said carriage assembly in either direction along said predetermined path; and means for detecting when said printing material fails to be advanced by at least a first predetermined amount when said drive means has been enabled to advance said printing material by at least a second predetermined amount.

2. The printing apparatus of claim 1, further comprising a roller engageable by said printing material and rotatable in response to advancement of said material by said drive means.

3. The printing apparatus of claim 2, wherein said roller has detectable indicia formed on a surface thereof and said means for detecting includes means for sensing each time one of said indicia passes a predetermined position during rotation of said roller.

4. The printing apparatus of claim 3, wherein said detectable indicia comprise a plurality of light-reflective strips and said means for sensing includes means for directing light toward said predetermined position and means for accepting light reflected off a reflective strip passing said predetermined position during rotation of said roller.

5. The printing apparatus of claim 4, wherein said means for detecting further includes means, responsive to the acceptance of reflected light by said means for accepting, for generating a first signal.

6. The printing apparatus of claim 5, further comprising means responsive to said first signal for disabling further advancement of said printing material.

7. The printing apparatus of claim 1, further comprising position transducer means coupled to said carriage drive assembly for generating position signal pulses as said carriage assembly is moved in either direction, the number of said position signal pulses generated being proportional to the distance of movement of said carriage assembly.

8. The printing apparatus of claim 7, further comprising counter means for counting said position pulses and for generating a second signal when the count capacity of said counter means has been reached, said second predetermined amount being represented by the count capacity of said counter means.

9. The printing apparatus of claim 8, further comprising means coupled to said means for generating a first signal for applying each generated first signal to said counter means for resetting same.

10. The printing apparatus of claim 9, wherein the spacing between said reflective strips defines said first predetermined amount.

11. The printing apparatus of claim 10, wherein said second predetermined amount is at least about four times as great as said first predetermined amount.

12. The printing apparatus of claim 11, further comprising a print member mounted to said carriage assembly and capable, when enabled, of printing alphanumeric characters, wherein said first predetermined amount is equivalent to a carriage movement of approximately about twelve character spaces, whereas said second predetermined distance is equivalent to a carriage movement of approximately about fifty-one character spaces.

13. The printing apparatus of claim 12, wherein said print member is a matrix print head capable, when enabled, of printing alphanumeric characters in a dot matrix, wherein each character space is comprised of five dot columns and the count capacity of said counting means is equal to 256.

14. The printing apparatus of claim 13, wherein said supply of printing material, at least a portion of said drive means and said roller are included in a cartridge.

15. The printing apparatus of claim 14, wherein said printing material is an endless-loop of ribbon bearing a predetermined marking substance.

* * * * *